US005229202A

United States Patent [19]

Tomono et al.

[11] Patent Number: 5,229,202

[45] Date of Patent: Jul. 20, 1993

[54] CARBON FIBER AND CARBON FIBER-REINFORCED RESIN COMPOSITION USING IT

[75] Inventors: Shigeki Tomono, Kodaira; Yoshihiro Sakamoto, Yokohama; Yasushi Omata, Zama; Manabu Fujiya, Yokohama, all of Japan

[73] Assignee: Mitsubishi Kasei Corporation, Tokyo, Japan

[21] Appl. No.: 702,399

[22] Filed: May 20, 1991

[30] Foreign Application Priority Data

May 22, 1990 [JP] Japan ..... 2-132379
May 22, 1990 [JP] Japan ..... 2-132381

[51] Int. Cl.[5] ..... B32B 27/12; B32B 27/28

[52] U.S. Cl. ..... 428/288; 423/447.1; 428/367; 428/378; 428/408; 528/288; 528/297; 528/335

[58] Field of Search ..... 428/367, 378, 408, 288, 428/292; 528/288, 297, 310, 335; 252/8.8; 423/447.1

[56] References Cited

U.S. PATENT DOCUMENTS 3,827,230 8/1974 Marzocchi et al. ..... 428/392
3,914,504 10/1975 Weldy ..... 428/367
4,147,833 4/1979 Eilerman et al. ..... 428/378
4,163,003 7/1979 Paul, Jr. et al. ..... 428/367
4,394,467 7/1983 Edelman ..... 523/205
4,555,446 11/1985 Sumida et al. ..... 428/367
4,615,946 10/1986 Temple ..... 428/361
4,751,258 6/1988 Minami ..... 523/414

FOREIGN PATENT DOCUMENTS 59-149922 8/1984 Japan .

*Primary Examiner*—George F. Lesmes
*Assistant Examiner*—Christopher Brown
*Attorney, Agent, or Firm*—Oblon, Spivak, McClelland, Maier & Neustadt

[57] ABSTRACT

A carbon fiber having its surface coated with a copolymer composed of a diamine compound, a dicarboxylic acid compound and a glycidyl polyalkylene oxide derivative of the following formula (I), wherein the copolymer contains said polyalkylene oxide derivative in an amount of from 10 to 50% by weight as in the monomer composition:

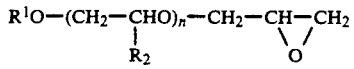

(I)

wherein $R^1$ is H or an alkyl group having not more than 20 carbon atoms, $R^2$ is H or $CH_3$, and n is an integer of from 1 to 40.

40 Claims, No Drawings

CARBON FIBER AND CARBON FIBER-REINFORCED RESIN COMPOSITION USING IT

The present invention relates to a carbon fiber and a carbon fiber-reinforced resin composition having the carbon fiber incorporated therein.

In recent years, an attention has been drawn to a fiber-reinforced resin composition having a carbon fiber mixed and dispersed in various matrix resins, as an industrially important material by virtue of its mechanical characteristics such as high strength, high stiffness, low specific gravity and high abrasion resistance.

Further, development is being made for the application of the carbon fiber wherein characteristics other than the mechanical properties such as strength, elastic modulus, such as electrical conductivity, thermal conductivity and X-ray transmittance, are utilized. Especially in the electronics-related field, it is frequently used as a conductive composite material wherein the high conductivity of the carbon fiber itself is utilized.

However, if the carbon fiber is merely mixed with a resin and molded, no adequate conductivity can be obtained unless a large amount of the carbon fiber is incorporated. This brings about an increase of the cost for the resin compound, a deterioration of the physical properties such as impact resistance, an increase of the specific gravity and a deterioration of the processability, due to the use of a large amount of the expensive carbon fiber. Thus, use of the carbon fiber has been restricted. To solve such problems, it has been attempted to improve the conductivity. For example, Japanese Unexamined Patent Publication No. 56586/1982 discloses that a carbon fiber is coated with a polyvinyl pyrrolidone to improve the conductivity of the composite material.

From the viewpoint of the mechanical strength, it is known that the interfacial adhesive strength between the resin and the carbon fiber is influential over the mechanical strength of the composite material. Particularly when the carbon fiber is dispersed in a resin in the form of short fibers having a length of from a few tens μm to a few mm, if the interfacial adhesive power is small, the strength of the composite material tends to be remarkably low. In order to improve this interfacial adhesive power, it has been attempted to treat the carbon fiber surface with a coupling agent or to coat it with a resin having good adhesive properties.

On the other hand, the adhesive power between the carbon fiber coated with a resin and the matrix resin varies depending upon the type of the matrix resin even when the same resin is coated on the carbon fiber. Therefore, development of coating resins suitable for the respective matrix resins is being made: For example, in a case where a polyamide resin is used as a matrix resin, it has been attempted to improve the adhesion to the matrix by a carbon fiber coated with a polyamide resin (Japanese Examined Patent Publication No. 7225/1987), or to improve the adhesion to the matrix by coating the fiber with a mixture of an epoxy resin and a silane coupling agent (Japanese Unexamined Patent Publication No. 53544/1985).

Further, a resin for treating the fiber surface, which is so-called a sizing agent, has a role of bundling fibers into a strand and improving the operation efficiency for e.g. cutting or weighing the fiber strand.

For the sizing step to coat a carbon fiber with a sizing agent, it is common to employ a method wherein a sizing agent is dissolved or emulsified and dispersed in water or in an organic solvent to form a liquid, and the carbon fiber is impregnated in the liquid, followed by removing the solvent. In this process, if an organic solvent is used, there will be disadvantages such that the operation environment deteriorates, and it is required to set up an installation for recovery of the solvent. Therefore, a sizing agent for an aqueous solution or aqueous dispersion system is preferred from the practical point of view.

However, conventional sizing agents did not satisfy various requirements for sizing agents, such as improvement of the interfacial adhesive properties, the bundling properties and the electrical conductivity, and easy sizing operation.

Under these circumstances, the present inventors have conducted an extensive research to solve such conventional problems and as a result, have found that by using a carbon fiber coated with a polymer having a specific composition, the bundling properties can be improved and it is possible to improve the strength and the electrical conductivity of a resin composite material by reinforcing the material with such a carbon fiber. The present invention has been accomplished on the basis of this discovery.

Namely, it is an object of the present invention to provide a carbon fiber for reinforcing a resin, which is capable of providing a resin composition having excellent bundling properties and presenting high strength and good electrical conductivity, and to provide a carbon fiber-reinforced resin composition using such a carbon fiber.

Such an object can readily be accomplished by:

a carbon fiber having its surface coated with a copolymer composed of a diamine compound, a dicarboxylic acid compound and a glycidyl polyalkylene oxide derivative of the following formula (I), wherein the copolymer contains said polyalkylene oxide derivative in an amount of from 10 to 50% by weight as in the monomer composition:

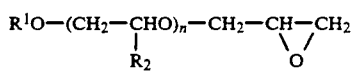

(I)

wherein $R^1$ is H or an alkyl group having not more than 20 carbon atoms, $R^2$ is H or $CH_3$, and n is an integer of from 1 to 40; and a carbon fiber-reinforced resin composition comprising 100 parts by weight of a thermoplastic resin having a polyamide group in the backbone chain structure and from 1 to 50 parts by weight of a carbon fiber incorporated thereto, said carbon fiber having its surface coated with a copolymer composed of a diamine compound, a dicarboxylic acid compound and a glycidyl polyalkylene oxide derivative of the following formula (I), wherein the copolymer contains said polyalkylene oxide derivative in an amount of from 10 to 50% by weight as in the monomer composition:

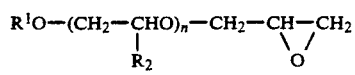

(I)

wherein $R^1$ is H or an alkyl group having not more than 20 carbon atoms, $R^2$ is H or $CH_3$, and n is an integer of from 1 to 40.

From the viewpoint of the electrical conductivity, such an object can better be accomplished by:

a carbon fiber having its surface coated with a copolymer composed of a diamine compound, a dicarboxylic acid compound, a cyclic amide compound and a glycidyl polyalkylene oxide derivative of the following formula (I), wherein the copolymer contains said polyalkylene oxide derivative in an amount of from 10 to 30% by weight as in the monomer composition:

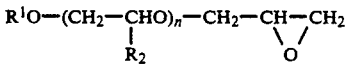

(I)

wherein $R^1$ is H or an alkyl group having not more than 20 carbon atoms, $R^2$ is H or $CH_3$, and n is an integer of from 1 to 40; and a carbon fiber-reinforced resin composition comprising 100 parts by weight of a thermoplastic resin having a polyamide group in the backbone chain structure and from 1 to 50 parts by weight of a carbon fiber incorporated thereto, said carbon fiber having its surface coated with a copolymer composed of a diamine compound, a dicarboxylic acid compound, a cyclic amide compound and a glycidyl polyalkylene oxide derivative of the following formula (I), wherein the copolymer contains said polyalkylene oxide derivative in an amount of from 10 to 30% by weight as in the monomer composition:

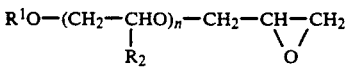

(I)

wherein $R^1$ is H or an alkyl group having not more than 20 carbon atoms, $R^2$ is H or $CH_3$, and n is an integer of from 1 to 40.

Now, the present invention will be described in detail with reference to the preferred embodiments.

As the carbon fiber in the present invention, various conventional carbon fibers can be used. Specifically, carbon fibers of polyacrylonitrile type, pitch type and rayon type may be mentioned.

The polymer to be used for coating is a copolymer of a diamine compound, a dicarboxylic acid compound, a cyclic amide compound and a glycidyl polyalkylene oxide.

The diamine compound is not particularly limited, but is preferably a compound of the formula (II):

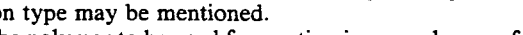

$$H_2N—R^3—NH_2 \quad (II)$$

wherein $R^3$ is an alkyl group having not more than 15 carbon atoms, and a derivative thereof. Specifically, it includes ethylenediamine, tetramethylenediamine, hexamethylenediamine, octamethylenediamine and decamethylenediamine, and methylated, ethylated and halogenated derivatives thereof.

The proportions of monomers in the monomer composition are determined within a range where the mixture is substantially completely polymerized to form a polymer having a proper molecular weight. To obtain an adequate effect for improving the electrical conductivity, the content of the diamine compound derivative is usually from 25 to 45% by weight. Further, in order to improve the adhesive strength or the bundling properties of the carbon fiber, it is preferably from 25 to 45% by weight. When the cyclic amide compound is contained in the monomer composition to improve the electrical conductivity, the content of the diamine compound derivative is usually from 10 to 30% by weight.

The dicarboxylic acid compound is preferably a compound of the formula (III):

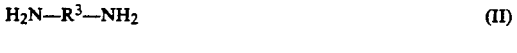

$$HOOC—R^4—COOH \quad (III)$$

wherein $R^4$ is an alkyl group having not more than 15 carbon atoms, or a single nucleus or two nuclei aromatic ring, or a derivative thereof. Specifically, it includes succinic acid, glutaric acid, adipic acid, pimelic acid, suberic acid, azelaic acid and sebacic acid, and methylated, ethylated and halogenated derivatives thereof, as well as aromatic dicarboxylic acids such as terephthalic acid, isophthalic acid and 2,6-naphthalene dicarboxylic acid.

The cyclic amide compound is an optional component which may be incorporated to improve the electrical conductivity. As such a cyclic amide compound, preferred is a compound of the formula (IV):

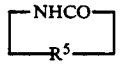

(IV)

wherein $R^5$ is an alkyl group having not more than 20 carbon atoms, or a derivative thereof. Specifically, it includes caprolactam and lauryllactam.

The glycidyl polyalkylene oxide derivative of the formula (I):

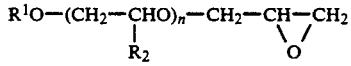

(I)

wherein n is an integer of from 1 to 40, preferably from 5 to 20, $R^1$ is an alkyl group having not more than 20 carbon atoms, and $R^2$ is H or $CH_3$, is an alkyl ether of an addition reaction product of ethylene oxide or propylene oxide having a glycicyl group at one terminal end. Specifically, it includes polyoxyethylene lauryl glycidyl ether and polyoxyethylene octylglycidyl ether.

The proportions of monomers in the monomer composition are determined within a range where the mixture is substantially completely polymerized to form a polymer having a proper molecular weight. To obtain an adequate effect for improving the electrical conductivity, the content of the glycidyl polyalkylene oxide derivative is usually from 10 to 50% by weight. Further, in order to improve the adhesive strength or the bundling properties of the carbon fiber, it is preferably from 30 to 50% by weight. When the cyclic amide compound is contained in the monomer composition to improve the electrical conductivity, the content of the glycidyl polyalkylene oxide derivative is usually from 10 to 30% by weight, preferably from 15 to 25% by weight. If the content of the glycidyl polyalkylene oxide derivative exceeds 50% by weight, the bundling properties of the carbon fiber strand tend to be poor, such being undesirable. On the other hand, if the content is less than 10% by weight, the strength of the composite material tends to be low, and the water-solubility tends to be low, such being undesirable.

Usually, the carbon fiber is used in the form of a strand formed by bundling a few thousands to a few tens thousands monofilaments, and the strand is sized by a resin to improve the handling efficiency, or it is incorporated in a resin to form a composite material having improved properties.

There is no particular restriction as to the method for applying the obtained copolymer to the carbon fiber surface. However, it is practical to adopt a method wherein carbon fiber strands are impregnated in an aqueous solution of the copolymer. The concentration of the aqueous solution may be adjusted to a level where the amount of the copolymer covering the carbon fiber would be a desired level. The amount of the copolymer coated on the carbon fiber is usually from 0.5 to 20% by weight, preferably from 2 to 10% by weight. If the coated amount is small, no adequate effects by the sizing agent for improving the properties of the composite material tend to be obtained, or the bundling properties of the carbon fiber tend to be inadequate. On the other hand, if the coated amount is too large, the physical properties of the composite material tend to deteriorate, or the handling efficiency of the carbon fiber strands after the sizing operation tends to be poor. The carbon fiber strands impregnated in the aqueous solution of the copolymer, will then be dried by ultraviolet rays or hot air. The drying temperature is preferably not higher than 300° C., so that no decomposition of the sizing agent will take place. The dried carbon fiber strands will then be cut to a length of from 1 to 20 mm, preferably from 3 to 10 mm, to facilitate the incorporation to a resin (the cut carbon fiber strands are called chopped strands).

The carbon fiber strands of the present invention are excellent in the bundling properties and the electrical conductivity. When incorporated to a resin, they present effects for improving the mechanical strength.

Now, a fiber-reinforced resin composition wherein such a carbon fiber is used as a reinforcing material, will be described.

As the matrix resin, conventional thermoplastic resins may be employed, for example, a thermoplastic resin having an amide group in the backbone chain structure, such as 6,6-nylon, 4,6-nylon, 6,10-nylon, 6-nylon or 12-nylon, a polymer such as polycarbonate, polystyrene, polyester, polyolefin, acrylate resin, polyoxymethylene, polyphenylene ether, polyphenylene oxide, polybutylene terephthalate, polyether ether ketone, polyphenylene sulfone or fluorine resin, or a copolymer thereof. Among them, to obtain a fiber-reinforced resin composition having particularly high strength, a thermoplastic resin having an amide group, such as 6,6-nylon, 6,4-nylon, 6,10-nylon, 6-nylon or 12-nylon, is preferred. Further, to obtain a fiber-reinforced resin composition having excellent electrical conductivity, it is preferred to employ a polymer such as polycarbonate, polystyrene, polyester, polyolefin, acrylate resin, polyoxymethylene, polyphenylene ether, polyphenylene oxide, polybutylene terephthalate, polyether ether ketone, polyphenylene sulfone or fluorine resin, or a copolymer thereof. It is particularly preferred to employ a polycarbonate, an acryronitrile-butadiene-styrene resin (ABS resin), a polybutylene terephthalate, polycarbonate or a polyphenylene oxide.

With respect to the blending ratio of the above described resin-reinforcing carbon fiber and the matrix resin, the carbon fiber is usually within a range of from 1 to 50 parts by weight, preferably from 5 to 40 parts by weight, per 100 parts by weight of the thermoplastic resin.

If the amount of the carbon fiber is less than 1 part by weight, no adequate reinforcing effects or no adequate conductivity-improving effects by the carbon fiber tend to be obtained. On the other hand, if the amount exceeds 50 parts by weight, various problems are likely to occur in the steps of mixing and dispersing the carbon fiber to the matrix resin.

There is no particular restriction as to the method for blending such a matrix resin and the carbon fiber of the present invention. However, it is common to employ a method using a single screw extruder, a twin screw extruder, a pressing machine, a high speed mixer, an injection molding machine or a pultrusion machine.

Further, in addition to the above mentioned components, fibrous reinforcing materials such as short fibers or long fibers of e.g. other types of carbon fibers, glass fibers, aramide fibers, boron fibers or silicon carbide fibers, whiskers, fibers having a metal such as nickel, aluminum or copper coated thereon, or metal fibers, or reinforcing materials composed of fillers such as carbon, molybdenum disulfide, mica, talc, or calcium carbonate, stabilizers, lubricants or other additives, may be incorporated to such an extent not to impair the effects of the present invention.

The carbon fiber-reinforced plastic resin composition thus obtained exhibits high strength and electrical conductivity as compared with the resin composition reinforced by conventional carbon fibers.

Now, the present invention will be described in further detail with reference to Examples. However, it should be understood that the present invention is by no means restricted to such specific Examples.

In these Examples, the physical properties were measured as follows.

Tensile strength of the molded product: ASTM D-638

Bulk density of chopped strands:

About 30 g of chopped strands were weighed.

About ⅓ thereof was sequentially put into a 200 ml measuring cylinder. Each time when the chopped strands were put into the measuring cylinder, the measuring cylinder was dropped ten times from a height of 5 cm. When the entire amount was packed, the volume was read.

The bulk density (d) was calculated from the weight (w) of the chopped strands and the volume (v) after the packing by the following formula:

$$d = v/w$$

Electrical conductivity:

The conductivity was evaluated by measuring the volume resistivity in accordance with SRIS 2301.

EXAMPLE (A) Preparation of a sizing agent 29 parts by weight of hexamethylenediamine, 36 parts by weight of adipic acid and 35 parts by weight of polyoxyethylene lauryl glycidyl ether (molecular weight: about 700) were mixed, and after flashing with nitrogen, the mixture of these monomers was heated to 220° C. and polymerized while removing water to obtain a polymer. This polymer was dissolved in water to obtain an aqueous solution, which was used as a sizing agent solution for impregnation of carbon fiber strands.

(B) Preparation of chopped strands 6,000 continuous filaments of pitch carbon fiber ("Dialead" K223, manufactured by Mitsubishi Kasei Corporation) were impregnated in the above mentioned 4% aqueous solution of the polymer, then heat-dried for 20 minutes at about 120° C. and cut by a cutting machine to obtain chopped strands having a length of 6 mm. The amount of the polymer coated on the chopped strands thus obtained and the bulk density are shown in Table 1 together with the data of Comparative Examples 1 to 4.

(C) Preparation of a molded product of short carbon fiber-reinforced resin 10 parts of the above chopped strands preliminarily dried and 100 parts by weight of pellets of 6,6-nylon resin "Bandain" (manufactured by U.S. Monsanto Company) were dry-blended and then fed into a screw extruder and melt-mixed and extruded. The extruded product was cooled with water and cut into pellets. The carbon fiber-incorporated resin material thus obtained was dried at 120° C. for 5 hours and then molded by an injection molding machine to obtain test specimens. Then, the tensile strength was measured. The results of the measurement are shown in Table 1 together with the results of Comparative Examples 1 to 4.

COMPARATIVE EXAMPLE 1

The test was conducted in the same manner as in Example 1 except that instead of the aqueous solution of the sizing agent in Example 1, an aqueous solution of α-(N,N-dimethylamino)-ε-caprolactam polymer, was used.

COMPARATIVE EXAMPLE 2

Test specimens were prepared and tested in the same manner as in Example 1 except that instead of the aqueous solution of the sizing agent in Example 1, an aqueous solution of polyethylene glycol (molecular weight: 50,000) was used as the sizing agent.

COMPARATIVE EXAMPLE 3

Test specimens were prepared and tested in the same manner as in Example 1 except that instead of the aqueous solution of the sizing agent in Example 1, an emulsion of an epoxy acrylate resin obtained by esterifying with acrylic acid the terminals of a bisphenol A type epoxy resin, was used as the sizing agent.

COMPARATIVE EXAMPLE 4

Chopped strands were prepared in the same manner as in Example 1 except that instead of the aqueous solution of the sizing agent in Example 1, an aqueous emulsion type sizing agent composed of a mixture comprising 60 parts by weight of an epoxy resin "Epicoat" 834 (manufactured by Shell Chemical Company Limited) and 40 parts by weight of "Epicoat" 1004 (manufactured by Shell Chemical Company Limited) was used. The chopped strands were mixed with pellets of 6,6-nylon resin, and the mixture was fed to a screw extruder, whereupon the viscosity of the molten resin increased, and rotation of the screw stopped during the kneading operation, and kneading could not be completed.

TABLE 1

| Example No. | Chopped strands: Amount of resin coated (wt %) | Chopped strands: Bulk density (g/l) | Tensile strength ($kg/cm^2$) |
|---|---|---|---|
| Example 1 | 3.1 | 450 | 1,750 |
| Comparative Example 1 | 3.0 | 430 | 1,600 |
| Comparative Example 2 | 2.7 | 300 | 1,670 |
| Comparative Example 3 | 3.3 | 450 | 1,480 |
| Comparative Example 4 | 3.5 | 420 | Kneading was impossible |

EXAMPLE 2

(A) Preparation of a sizing agent 25 parts of hexamethylenediamine, 31 parts by weight of adipic acid, 24 parts by weight of caprolactam and 20 parts by weight of polyoxyethylene lauryl glycidyl ether (molecular weight: about 700) were mixed, and after flashing with nitrogen, the mixture of these monomers was heated to 220° C. and polymerized while removing water to obtain a polymer. This polymer was dissolved in water to obtain an aqueous solution, which was used as a sizing agent solution for impregnation of carbon fiber strands.

(B) Preparation of chopped strands 6,000 continuous filaments of pitch type carbon fiber ("Dialead" K223, manufactured by Mitsubishi Kasei Corporation) were impregnated in the above 4% aqueous solution of the polymer, then heat-dried for 20 minutes at about 120° C. and cut by a cutting machine to obtain chopped strands having a length of 6 mm. The amount of the polymer coated on the chopped strands is shown in Table 2 together with the results of Comparative Examples 5 to 9.

(C) Preparation of a molded product of short carbon fiber reinforced resin 10 parts by weight of the above chopped strands preliminarily dried and 100 parts by weight of pellets of polybutylene terephthalate resin "Nobadol" 5008 (manufactured by Mitsubishi Kasei Corporation) were dry-blended, then fed to a screw extruder and melt-mixed. The extruded product was cooled with water and cut into pellets. The carbon fiber-incorporated resin material thus obtained was dried at 120° C. for 5 hours and then molded by an injection molding machine to obtain test specimens. The volume resistivity was measured. The results of the measurement are shown in Table 2 together with the results of Comparative Examples 5 to 9.

COMPARATIVE EXAMPLE 5

Polymerization was conducted, chopped strands were prepared and a molded product of carbon fiber-reinforced resin was prepared in the same manner as in Example 2 with a monomer composition comprising 29 parts by weight of hexamethylenediamine, 36 parts by weight of adipic acid and 35 parts by weight of polyoxyethylene lauryl glycidyl ether (molecular weight: 700), and the volume resistivity was measured.

COMPARATIVE EXAMPLE 6

Preparation of chopped strands and preparation of a molded product of carbon fiber-reinforced resin were conducted in the same manner as in Example 2 except that instead of the aqueous solution of the sizing agent in Example 2, an aqueous solution of α-(N,N-dimethylamino)-ε-caprolactam polymer was used, and the volume resistivity was measured.

COMPARATIVE EXAMPLE 7

Test specimens were prepared in the same manner as in Example 2 except that instead of the aqueous solution of the sizing agent in Example 2, an aqueous emulsion type sizing agent comprising 60 parts by weight of an epoxy resin "Epicoat" 834 (manufactured by Shell Chemical Company Limited) and 40 parts by weight of "Epicoat" 1004 (manufactured by Shell Chemical Company Limited) was used.

COMPARATIVE EXAMPLE 8

Test specimens were prepared in the same manner as in Example 2 except that instead of the aqueous solution of the sizing agent in Example 2, an aqueous solution of polyvinyl pyrrolidone (molecular weight: 40,000) was used as the sizing agent.

COMPARATIVE EXAMPLE 9

Test specimens were prepared in the same manner as in Example 2 except that instead of the aqueous solution of the sizing agent in example 2, an aqueous solution of polyethylene glycol (molecular weight: 50,000) was used as the sizing agent.

EXAMPLE 3

Test specimens were prepared in the same manner as in Example 2 except that instead of the matrix resin polybutylene terephthalate in Example 2, a polycarbonate resin was used, and the amount of the resin-coated carbon fiber was changed to 20 parts by weight. The result of the measurement of the volume resistivity is shown in Table 3 together with the results of Comparative Examples 10 to 14.

COMPARATIVE EXAMPLES 10 to 14

Test specimens were prepared in the same manner as in Comparative Examples 5 to 9 except that the matrix resin was changed from the polybutylene terephthalate to a polycarbonate resin, and the amount of the resin-coated carbon fiber was changed to 20 parts by weight, and the volume resistivity was measured.

As shown in Tables 2 and 3, it is possible to obtain resin compositions having better electrical conductivity by using a carbon fiber coated with the resin having the composition of the present invention than using a carbon fiber coated with other resins.

TABLE 2

| Example No. | Amount of resin coated on chopped strands (wt %) | Volume resistivity (Ω · cm) |
|---|---|---|
| Example 2 | 3.0 | $4 \times 10^0$ |
| Comparative Example 5 | 2.5 | $8 \times 10^0$ |
| Comparative Example 6 | 2.8 | $1 \times 10^1$ |
| Comparative Example 7 | 3.2 | $6 \times 10^1$ |
| Comparative Example 8 | 2.7 | $4 \times 10^1$ |
| Comparative | 2.7 | $3 \times 10^1$ |

TABLE 2-continued

| Example No. | Amount of resin coated on chopped strands (wt %) | Volume resistivity (Ω · cm) |
|---|---|---|
| Example 9 | | |

Matrix: polybutyrene terephthalate
Amount of carbon fiber incorporated: 10 parts by weight per 100 parts by weight of matrix resin

TABLE 3

| Example No. | Volume resistivity (Ω · cm) |
|---|---|
| Example 3 | $6 \times 10^0$ |
| Comparative Example 10 | $4 \times 10^1$ |
| Comparative Example 11 | $2 \times 10^1$ |
| Comparative Example 12 | $4 \times 10^1$ |
| Comparative Example 13 | $7 \times 10^2$ |
| Comparative Example 14 | $2 \times 10^1$ |

Matrix: polycarbonate
Amount of carbon fiber incorporated: 20 parts by weight per 100 parts by weight of matrix resin The resin-coated carbon fiber of the present invention has an effect of improving the electrical conductivity of a carbon fiber-reinforced thermoplastic resin to a large extent as compared with the conventional carbon fibers, and it is very useful from the industrial point of view, as well as the fiber-reinforced resin having such a fiber incorporated therein.

What is claimed is:

1. A carbon fiber having its surface coated with a copolymer composed of a diamine compound, a dicarboxylic acid compound and a glycidyl polyalkylene oxide derivative of the following formula (I), wherein the copolymer contains said polyalkylene oxide derivative in an amount of from 10 to 50% by weight as in the monomer composition:

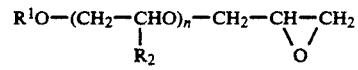

(I)

wherein $R^1$ is H or an alkyl group having not more than 20 carbon atoms, $R^2$ is H or $CH_3$, and n is an integer of from 1 to 40.

2. The carbon fiber according to claim 1, wherein said copolymer contains said polyalkylene oxide derivative in an amount of from 30 to 50% by weight as in the monomer composition.

3. The carbon fiber according to claim 1, wherein said diamine compound is a compound of the following formula (II):

$$H_2N—R^3—NH_2 \quad \text{(II)}$$

wherein $R^3$ is an alkyl group having not more than 15 carbon atoms, or a derivative thereof.

4. The carbon fiber according to claim 1, wherein said diamine compound is selected from the group consisting of ethylenediamine, tetramethylenediamine, hexamethylenediamine, octamethylenediamine and decamethylenediamine, and methylated, ethylated and halogenated derivatives thereof.

5. The carbon fiber according to claim 1, wherein said copolymer contains said diamine compound in an amount of from 25 to 45 % by weight as in the monomer composition.

6. The carbon fiber according to claim 1, wherein said dicarboxylic acid compound is a compound of the following formula (III):

$$HOOC—R^4—COOH \quad (III)$$

wherein $R^4$ is an alkyl group having not more than 15 carbon atoms, or a single nucleus or two nuclei aromatic ring, or a derivative thereof.

7. The carbon fiber according to claim 1, wherein said dicarboxylic acid compound is selected from the group consisting of succinic acid, glutaric acid, adipic acid, pimelic acid, suberic acid, azelaic acid and sebacic acid, and methylated, ethylated and halogenated derivatives thereof.

8. The carbon fiber according to claim 1, wherein said dicarboxylic acid is terephthalic acid, isophthalic acid or 2,6-naphthalenedicarboxylic acid.

9. The carbon fiber according to claim 1, wherein the amount of the copolymer coated is from 0.5 to 20% by weight.

10. A carbon fiber-reinforced resin composition comprising 100 parts by weight of a thermoplastic matrix resin and from 1 to 50 parts by weight of a carbon fiber incorporated therein, said carbon fiber having its surface coated with a copolymer composed of a diamine compound, a dicarboxylic acid compound and a glycidyl polyalkylene oxide derivative of the following formula (I), wherein the copolymer contains said polyalkylene oxide derivative in an amount of from 10 to 50% by weight as in the monomer composition:

$$R^1O—(CH_2—\underset{\underset{R_2}{|}}{CH}O)_n—CH_2—\underset{\underset{O}{\diagdown\ \diagup}}{CH—CH_2} \quad (I)$$

wherein $R^1$ is H or an alkyl group having not more than 20 carbon atoms, $R^2$ is H or $CH_3$, and n is an integer of from 1 to 40.

11. The carbon fiber-reinforced resin composition according to claim 10, wherein said copolymer contains said polyalkylene oxide derivative in an amount of from 30 to 50% by weight as in the monomer composition.

12. The carbon fiber-reinforced resin composition according to claim 10, wherein said diamine compound is a compound of the following formula (II):

$$H_2N—R^3—NH_2 \quad (II)$$

wherein $R^3$ is an alkyl group having not more than 15 carbon atoms, or a derivative thereof.

13. The carbon fiber-reinforced resin composition according to claim 10, wherein said diamine compound is selected from the group consisting of ethylenediamine, tetramethylenediamine, hexamethylenediamine, octamethylenediamine and decamethylenediamine, and methylated, ethylate and halogenated derivatives thereof.

14. The carbon fiber-reinforced resin composition according to claim 10, wherein said copolymer contains said diamine compound in an amount of from 25 to 45% by weight as in the monomer composition.

15. The carbon fiber-reinforced resin composition according to claim 10, wherein said dicarboxylic acid compound is a compound of the following formula (III):

$$HOOC—R^4—COOH \quad (III)$$

wherein $R^4$ is an alkyl group having not more than 15 carbon atoms, or a single nucleus or two nuclei aromatic ring, or a derivative thereof.

16. The carbon fiber-reinforced resin composition according to claim 10, wherein said dicarboxylic acid compound is selected from the group consisting of succinic acid, glutaric acid, adipic acid, pimelic acid, suberic acid, azelaic acid and sebacic acid, and methylated, ethylated and halogenated derivatives thereof.

17. The carbon fiber-reinforced resin composition according to claim 10, wherein said dicarboxylic acid is terephthalic acid, isophthalic acid or 2,6-naphthalenedicarboxylic acid.

18. The carbon fiber-reinforced resin composition according to claim 10, wherein the amount of the copolymer coated is from 0.5 to 20% by weight.

19. A carbon fiber having its surface coated with a copolymer composed of a diamine compound, a dicarboxylic acid compound, a cyclic amide compound and a glycidyl polyalkylene oxide derivative of the following formula (I), wherein the copolymer contains said polyalkylene oxide derivative in an amount of from 10 to 30% by weight as in the monomer composition:

$$R^1O—(CH_2—\underset{\underset{R_2}{|}}{CH}O)_n—CH_2—\underset{\underset{O}{\diagdown\ \diagup}}{CH—CH_2} \quad (I)$$

wherein $R^1$ is H or an alkyl group having not more than 20 carbon atoms, $R^2$ is H or $CH_3$, and n is an integer of from 1 to 40.

20. The carbon fiber according to claim 19, wherein said copolymer contains said polyalkylene oxide derivative in an amount of from 15 to 25% by weight as in the monomer composition.

21. The carbon fiber according to claim 19, wherein said diamine compound is a compound of the following formula (II):

$$H_2N—R^3—NH_2 \quad (II)$$

wherein $R^3$ is an alkyl group having not more than 15 carbon atoms, or a derivative thereof.

22. The carbon fiber according to claim 19, wherein said diamine compound is selected from the group consisting of ethylenediamine, tetramethylenediamine, hexamethylenediamine, octamethylenediamine and decamethylenediamine, and methylated, ethylated and halogenated derivatives thereof.

23. The carbon fiber according to claim 19, wherein said copolymer contains said diamine compound in an amount of from 10 to 30% by weight as in the monomer composition.

24. The carbon fiber according to claim 19, wherein said dicarboxylic acid compound is a compound of the following formula (III):

$$HOOC—R^4—COOH \quad (III)$$

wherein $R^4$ is an alkyl group having not more than 15 carbon atoms, or a single nucleus or two nuclei aromatic ring, or a derivative thereof.

25. The carbon fiber according to claim 19, wherein said dicarboxylic acid compound is selected from the group consisting of succinic acid, glutaric acid, adipic acid, pimelic acid, suberic acid, azelaic acid and sebacic acid, and methylated, ethylated and halogenated derivatives thereof.

26. The carbon fiber according to claim 19, wherein said dicarboxylic acid is terephthalic acid, isophthalic acid or 2,6-naphthalenedicarboxylic acid.

27. The carbon fiber according to claim 19, wherein said amount of the copolymer coated is from 0.5 to 20% by weight.

28. A carbon fiber-reinforced resin composition comprising 100 parts by weight of a thermoplastic matrix resin and from 1 to 50 parts by weight of a carbon fiber incorporated therein, said carbon fiber having its surface coated with a copolymer composed of a diamine compound, a dicarboxylic acid compound, a cyclic amide compound and a glycidyl polyalkylene oxide derivative of the following formula (I), wherein the copolymer contains said polyalkylene oxide derivative in an amount of from 10 to 30% by weight as in the monomer composition:

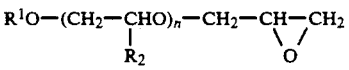

$$R^1O-(CH_2-\underset{\underset{R_2}{|}}{CHO})_n-CH_2-\underset{\underset{O}{\diagdown\diagup}}{CH-CH_2} \quad (I)$$

wherein $R^1$ is H or an alkyl group having not more than 20 carbon atoms, $R^2$ is H or $CH_3$, and n is an integer of from 1 to 40.

29. The carbon fiber-reinforced resin composition according to claim 28, wherein said copolymer contains said polyalkylene oxide derivative in an amount of from 15 to 25% by weight as in the monomer composition.

30. The carbon fiber-reinforced resin composition according to claim 28, wherein said diamine compound is a compound of the following formula (II):

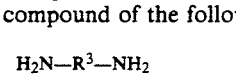

$$H_2N-R^3-NH_2 \quad (II)$$

wherein $R^3$ is an alkyl group having not more than 15 carbon atoms, or a derivative thereof.

31. The carbon fiber-reinforced resin composition according to claim 28, wherein said diamine compound is selected from the group consisting of ethylenediamine, tetramethylenediamine, hexamethylenediamine, octamethylenediamine and decamethylenediamine, and methylated, ethylated and halogenated derivatives thereof.

32. The carbon fiber-reinforced resin composition according to claim 28, wherein said copolymer contains said diamine compound in an amount of from 10 to 30% by weight as in the monomer composition.

33. The carbon fiber-reinforced resin composition according to claim 28, wherein said dicarboxylic acid compound is a compound of the following formula (III):

$$HOOC-R^4-COOH \quad (III)$$

wherein $R^4$ is an alkyl group having not more than 15 carbon atoms, or a single nucleus or two nuclei aromatic ring, or a derivative thereof.

34. The carbon fiber-reinforced resin composition according to claim 28, wherein said dicarboxylic acid compound is selected from the group consisting of succinic acid, glutaric acid, adipic acid, pimelic acid, suberic acid, azelaic acid and sebacic acid, and methylated, ethylated and halogenated derivatives thereof.

35. The carbon fiber-reinforced resin composition according to claim 28, wherein said dicarboxylic acid is terephthalic acid, isophthalic acid or 2,6-naphthalenedicarboxylic acid.

36. The carbon fiber-reinforced resin composition according to claim 28, wherein the amount of the copolymer coated is from 0.5 to 20% by weight.

37. The carbon fiber-reinforced resin composition according to claim 10, 6,6-nylon, 6,4-nylon, 6,10-nylon, 6-nylon or 12-nylon is used as the matrix resin.

38. The carbon fiber-reinforced resin composition according to claim 28, wherein a polycarbonate, a acrylonitrile-butadiene-styrene resin, a polybutylene terephthalate, polycarbonate or a polyphenylene oxide is used as the matrix resin.

39. The carbon fiber-reinforced resin composition according to claim 10, wherein the carbon fiber is incorporated in an amount of from 1 to 50 parts by weight per 100 parts by weight of the matrix resin.

40. The carbon fiber-reinforced resin composition according to claim 28, wherein the carbon fiber is incorporated in an amount of from 1 to 50 parts by weight per 100 parts by weight of the matrix resin.

* * * * *